United States Patent [19]

Peterson et al.

[11] Patent Number: 4,682,372

[45] Date of Patent: Jul. 28, 1987

[54] PROTECTIVE APRON

[76] Inventors: Lars-Eric Peterson, Roslagsgatan 50-52C, S-113 53 Stockholm; Jan Söderlind, Smålandsgatan 41, S-186 00 Vallentuna, both of Sweden

[21] Appl. No.: 942,085

[22] Filed: Dec. 15, 1986

[51] Int. Cl.[4] ..... A41B 13/10

[52] U.S. Cl. ..... 2/51

[58] Field of Search ..... 2/48, 50, 51, 52

[56] References Cited

FOREIGN PATENT DOCUMENTS 861262 11/1986 Sweden .

*Primary Examiner*—Doris L. Troutman

*Attorney, Agent, or Firm*—Witherspoon & Hargest

[57] ABSTRACT

A protective apron that covers the chest, belly and crutch area of the body of used by a butcher to protect against knife wounds. A hinge assembly on the apron that allows the butcher to bend forward without substantial restriction.

4 Claims, 2 Drawing Figures

PROTECTIVE APRON

FIELD OF INVENTION

Figure 1:
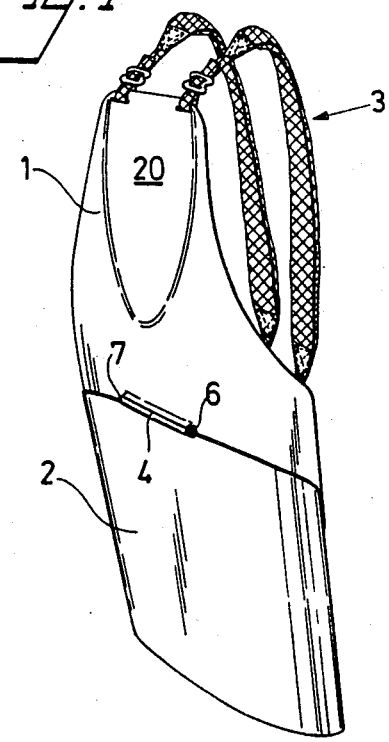

This invention relates to a protective apron. In particular this invention relates to a chest, belly and crutch protection apron suitable for use by butchers to protect against knife wounds in the chest, belly and crutch.

PRIOR ART

Butchers accidently cut themselves in the areas referred to above. A most serious situation occurs if the main blood vessels inside the crutch are cut. Several devices have been previously designed to protect against injuries in the abdomen and belly area. However, these have not proved to be satisfactory, especially not to protect the crutch and the upper portions of the legs. It is not just a matter of making the existing protective aprons longer in order to protect the crutch area and some portion below since the apron must be flexible thus allowing the butcher to bend forward without substantial restriction.

Flexible protective aprons are known from e.g. U.S. Pat. No. 3,611,438 . The apron disclosed therein comprises three contoured strip segments mounted horizontally one over another in overlapping relationship the uppermost segment is fixed to the body by a harness and the lower contoured segments are depending from the fixed segment at rivets or pivotal pins provided at the upper portions of the side edges of the depending sections, said rivets sliding in vertical oblong slots provided at the side edges of the overlapping strip segments. When the wearer bends forward the segments begin to pivot relative to one another. Simultaneously the apron will tend to shorten by causing the pivot pins to slide from their lower portion in the oblong slots to their upper portions in the slots. In this position the segments dig into the wearer's body. The wearer will experience the apron as uncomfortable while in this shortened position.

Also, in this protective apron there will inevitably be a small gap between the overlapping portions of the segments when the wearer is bending over. This is hazardous since a knife then may slip through the gap and penetrate or otherwise injure the wearer's body.

SUMMARY

The present invention overcomes the above mentioned drawbacks of the prior art by providing an apron which is made by two substantially rigid puncture-resistant contoured panels jointed together in substantial overlapping relationship by hinge means provided centrally on said panels thereby permitting the lower panel of the apron to perform a pure rotational movement around said hinge means in a direction out from the stationary upper panel which in a manner known per se is fixed to the wearer's chest by means of a harness provided on said upper panel.

Figure 2:
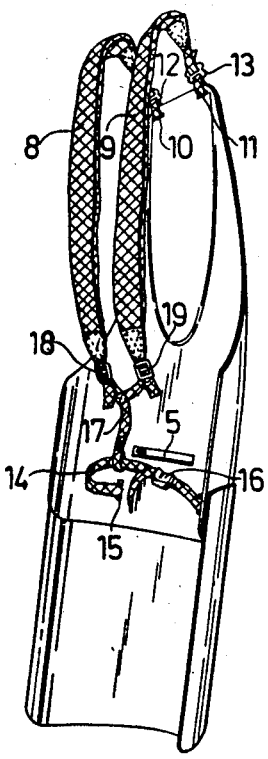

A preferred embodiment of the invention will be described with reference to the following detailed specification read in conjunction with the drawing wherein:

FIG. 1 is a front perspective view of the protective apron in accordance with the invention, and FIG. 2 is a back perspective view of the apron shown in FIG. 1.

The protection apron shown in FIG. 1 comprises an upper panel 1, a lower panel 2, a harness 3 and a hinge 4. Both panels 1 and 2 are curved or contoured to follow the curvature of the chest of the wearer. The panels are made from a puncture resistant substantially rigid material such as high density polyethylene, polycarbonate or the like. Polycarbonate is preferred. Centrally between the side edges of the upper panel 1 and about 6–7 inches over its lower edge there is an elongate indentation 5 (FIG. 2) extending transversely to the longitudinal central axis of the apron the length of the indentation is in the order of about 4–6 inches, the width thereof is in the order of abut ½ inch. The indentation 5 is made in the back surface, that is in the surface facing the wearer's body, of the upper panel and will therefore form an oblong transverse ridge protruding from the front surface of the upper panel. The end surfaces of the indentation are generally planar and extend generally perpendicular to the front surface while the upper, lower and bottom surfaces of said indentation are rounded and together U-formed shape as appears from FIG. 1 at reference numeral 4.

At the top of the front surface of the lower panel 2 there are two lugs 6 and 7 integral with the lower panel and extending generally perpendicular to the front surface. The distance between said lugs corresponds to the tranverse length of the indentation 5 on the upper panel 1. The lower panel 2 is placed on the upper panel 1 with its lugs opposite to and outside each side wall of the indentation 5 of the upper panel 1. Pivot pins, of which only one is visible in FIG. 1, are inserted in openings provided in said opposite side walls and lugs, respectively, so as to form said hinge 4. The pivot pins are preferably solid resin plugs crimp-fitted into said openings. Instead of plugs, bolts and screws can be used, or one single bolt or rivet can extend through both lugs and both side walls to form said hinge.

The harness 3 comprises two straps 8, 9 each of which at one end thereof is passed through a longitudinal slot 10 and 11 provided in the upper portion of the upper panel 1 and is folded back and secured by means of a buckle 12 and 13 respectively. A waist strap 14 extends through vertical slots 15 provided in the lower portion of the upper panel 1 at each side of the longitudinal center axis of the apron. The waist strap 14 is also provided with a buckle 16 permitting control of the length of the waist strap. A T-shaped connection strap 17 secures each remaining end of said straps 8, 9 by way of buckles 18, 19. The connection strap 17 has a loop through which the waist strap 14 is passed.

The upper panel 1 has a portion 20 which is generally flat.

From the above it is clear that the lower panel may be pivoted around the hinge while still maintaining a substantial overlap between the two panels 1 and 2, thus offering appropriate protection against knife wounds even when the lower panel is swung out from the wearer'body.

We claim:

1. A chest, belly and crutch protective apron comprising an upper and a lower panel consisting of a puncture-resistant material, said panels being curved to conform with the wearer's body, said upper and lower segments being arranged one above the other in a substantially overlapping relationship by hinge means, wherein said hinge means comprises an elongate indentation provided in the upper panel and extending transversely to the longitudinal axis of the apron, lug means which are provided at the upper portion of the lower panel and spaced apart a distance corresponding to the distance between generally flat end walls delimiting the extension of said indentation in said transverse direction and pivot pin means extending through openings provided in said end walls and said lugs, so as to pivotally connect said upper and lower panels to each other, and harness means to support said apron on the wearer.

2. A protective apron in accordance with claim 1, wherein said indentation is provided at a distance above the lower edge of the upper panel, said distance corresponding to said substantially overlapping relationship.

3. A protective apron in accordance with claim 2, wherein said indentation is centered in relation to the side edges of the upper panel.

4. A protective apron in accordance with claim 1, wherein said harness means are fixed to the upper panel and comprise a pair of straps attached to one end thereof in spaced apart longitudinal slots provided in the upper portion of the upper panel, a waist strap extending through spaced-apart vertical slots provided below the indentation in the lower region of the upper panel, and a T-shaped connection strap for connecting the other ends of said straps thereto and for connection to the waist strap.

* * * * *